US009236181B2

(12) United States Patent
Maeda

(10) Patent No.: US 9,236,181 B2
(45) Date of Patent: Jan. 12, 2016

(54) LAMINATED COIL COMPONENT AND METHOD FOR PRODUCING SAME

(71) Applicant: MURATA MANUFACTURING CO., LTD., Kyoto-fu (JP)

(72) Inventor: Eiichi Maeda, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/670,938

(22) Filed: Mar. 27, 2015

(65) Prior Publication Data

US 2015/0294780 A1 Oct. 15, 2015

Related U.S. Application Data

(63) Continuation of application No. PCT/JP2013/077997, filed on Oct. 15, 2013.

(30) Foreign Application Priority Data

Oct. 19, 2012 (JP) ..... 2012-232275

(51) Int. Cl.
*H01F 5/00* (2006.01)
*H01F 27/28* (2006.01)
(Continued)

(52) U.S. Cl.
CPC ..... *H01F 27/2804* (2013.01); *H01F 1/01* (2013.01); *H01F 1/032* (2013.01); *H01F 41/046* (2013.01); *H01F 2027/2809* (2013.01)

(58) Field of Classification Search
CPC ..... H01F 5/00; H01F 27/28; H01F 17/0013; H01F 41/04; H01F 27/25; H01F 1/24
USPC ..... 336/200, 232, 233; 252/62.51 R, 62.55
See application file for complete search history.

(56) References Cited

U.S. PATENT DOCUMENTS 6,008,151 A * 12/1999 Sasaki ..... C03C 10/0054 501/17
6,147,573 A * 11/2000 Kumagai ..... H01F 17/0013 333/185

(Continued)

FOREIGN PATENT DOCUMENTS

JP H01-318213 A 12/1989
JP 2004-343084 A 12/2004

(Continued)

OTHER PUBLICATIONS

International Search Report; PCT/JP2013/077997; Nov. 19, 2013.

(Continued)

*Primary Examiner* — Tsz Chan
(74) *Attorney, Agent, or Firm* — Studebaker & Brackett PC

(57) ABSTRACT

A laminated coil component includes a magnetic material part containing a metal magnetic material and a first glass component, and a nonmagnetic material part containing a ceramic material and a second glass component, and a coil conductor is formed so that at least the main surface of a coil pattern is in contact with the nonmagnetic material part. The magnetic material part is formed with the volume content of the first glass component based on the total amount of the metal magnetic material and the first glass component is 46 to 60 vol %. The nonmagnetic material part is formed with the volume content of the second glass component based on the total amount of the ceramic material and the second glass component is 69 to 79 vol %. A laminated coil component having good high-frequency characteristics and magnetic characteristics is obtained and a method for producing the laminated coil component.

8 Claims, 12 Drawing Sheets

(51) Int. Cl.

| | |
|---|---|
| ***H01F 17/04*** | (2006.01) |
| ***H01F 7/06*** | (2006.01) |
| ***H01F 1/04*** | (2006.01) |
| ***H01F 1/14*** | (2006.01) |
| ***H01F 1/032*** | (2006.01) |
| ***H01F 41/04*** | (2006.01) |
| ***H01F 1/01*** | (2006.01) |

(56) References Cited

U.S. PATENT DOCUMENTS

| | | | | |
|---|---|---|---|---|
| 6,165,379 | A * | 12/2000 | Kono | C03C 8/18 252/62.59 |
| 7,034,637 | B2 | 4/2006 | Kono et al. | |
| 2006/0170524 | A1 * | 8/2006 | Fujiwara | H01F 1/15366 336/83 |
| 2010/0201473 | A1 * | 8/2010 | Konoue | H01F 17/0013 336/200 |
| 2011/0181384 | A1 * | 7/2011 | Inuduka | C03C 14/004 336/234 |
| 2013/0033354 | A1 | 2/2013 | An et al. | |
| 2013/0194060 | A1 | 8/2013 | Nakada et al. | |

FOREIGN PATENT DOCUMENTS

| | | | |
|---|---|---|---|
| JP | 2005-317748 | A | 11/2005 |
| JP | 2006-041081 | A | 2/2006 |
| JP | 2007-266245 | A | 10/2007 |
| JP | 2009-239159 | A | 10/2009 |
| JP | 2010-062424 | A | 3/2010 |
| JP | 2013-033966 | A | 2/2013 |
| JP | 2013-055078 | A | 3/2013 |
| WO | 2012/005069 | A1 | 1/2012 |

OTHER PUBLICATIONS

Written Opinion of the International Searching Authority; PCT/JP2013/077997; Nov. 19, 2013.

* cited by examiner

LAMINATED COIL COMPONENT AND METHOD FOR PRODUCING SAME

CROSS REFERENCE TO RELATED APPLICATIONS

This application claims benefit of priority to Japanese Patent Application No. 2012-232275 filed Oct. 19, 2012, and to International Patent Application No. PCT/JP2013/077997 filed Oct. 15, 2013, the entire content of each of which is incorporated herein by reference.

TECHNICAL FIELD

The present technical field relates to a laminated coil component and a method for producing the same, and more particularly to a laminated coil component using a metal magnetic material for a magnetic material part, and a method for producing the same.

BACKGROUND

A laminated coil component with a coil conductor included in a component element assembly formed of a magnetic material composition has been heretofore known as an electronic component used for a choke coil that is used at a high-frequency, a power supply circuit through which a large current passes, a power inductor for a DC/DC converter circuit, or the like.

In this type of laminated coil component, when an apparent relative permittivity increases between coil conductors or between a coil conductor and an external electrode to increase a stray capacitance, the resonance frequency may be shifted to a low frequency side, leading to deterioration of high-frequency characteristics.

For avoiding such an increase in stray capacitance, a low-dielectric-constant layer having a low relative permittivity may be provided as a part of the component element assembly.

In this case, however, when different materials are co-sintered in the production process, structural defects such as cracking and peeling may occur due to mutual diffusion and a difference in shrinkage behavior between materials.

Thus, for example, JP 2004-343084 A proposes an electronic component including: a magnetic material part composed of an iron-based oxide magnetic composition; a nonmagnetic material part formed in contact with the magnetic material part and composed of a glass ceramic composite composition; and an internal conductor part formed on at least one of the magnetic material part and the nonmagnetic material part, wherein the glass ceramic composite composition contains a crystallized glass as a main component and a quartz as a filler as a secondary component, the crystallized glass contains 25 wt % to 55 wt % of $SiO_2$, 30 wt % to 55 wt % of MgO, 5 wt % to 30 wt % of $Al_2O_2$ and 0 wt % to 30 wt % of $B_2O_2$, and the quartz is contained in an amount of 5 to 30 parts by weight based on 100 parts by weight of the crystallized glass and dispersed in the crystallized glass.

In JP 2004-343084 A, the magnetic material part is formed of an iron-based oxide magnetic composition (ferrite-based magnetic material), and the nonmagnetic material part composed of a glass ceramic composite composition is formed in contact with the magnetic material part. A glass ceramic composite composition having reduced mutual diffusion between itself and the iron-based oxide magnetic composition that forms the magnetic material part is used to thereby obtain good co-sinterability.

Since the glass ceramic composite composition described in JP 2004-343084 A has a low magnetic permeability and dielectric constant, good insulation quality, and an effect of suppressing diffusion to a metal material such as Ag, a low-resistance material such as Ag can be used for an internal conductor, so that the direct-current resistance of an electronic component can be reduced.

On the other hand, a metal magnetic material is harder to be magnetically saturated as compared to a ferrite-based magnetic material, and has good direct-current superimposition characteristics, and therefore various kinds of laminated coil components obtained by using the metal magnetic material have been heretofore proposed.

For example, JP 2010-62424 A proposes a method for producing an electronic component, wherein a glass containing $SiO_2$, $B_2O_3$ and ZnO as main components and having a softening temperature of 600±50° C. is added to a magnetic alloy material containing Cr, Si and Fe so that the volume of the glass is less than 10% of the volume of the magnetic alloy material, whereby a surface of the magnetic alloy material is covered with the glass to obtain a metal magnetic material, a molded article including a coil is formed using the metal magnetic material, and the molded article is fired at 700° C. or higher and lower than the melting point of a conductor material of the coil in a non-oxidizing atmosphere in vacuum, or without oxygen or at a low oxygen partial pressure.

In JP 2010-62424 A, a sufficient glass film can be formed on the surface of the metal magnetic material, and therefore generation of a gap between metal magnetic materials can be suppressed, whereby the insulation resistance can be increased without increasing the coil resistance, so that an electronic component such as a power inductor, which has good direct-current superimposition characteristics and a low magnetic loss, can be obtained.

SUMMARY

Problem to be Solved by the Disclosure

In JP 2004-343084 A, however, although a glass ceramic composite oxide having reduced mutual diffusion with an iron-based oxide magnetic composition (ferrite-based magnetic material) is used, a magnetic material part (iron-based oxide magnetic composition) and a nonmagnetic material part (glass ceramic composite composition) formed in contact with the magnetic material part are co-sintered, and therefore structural defects such as cracking and peeling at an interface between the magnetic material part and the nonmagnetic material part, and deformation may occur unless firing conditions are controlled with high accuracy.

Moreover, in JP 2004-343084 A, the magnetic material part is formed of a ferrite-based magnetic material poor in direct-current superimposition characteristics, and therefore easily magnetically saturated in a large-current region, so that a practical region may be limited.

In JP 2010-62424 A, a metal magnetic material superior in direct-current superimposition characteristics to a ferrite-based magnetic material, and a glass film having a sufficient thickness is formed on a surface of the metal magnetic material, so that insulation quality can be improved.

In JP 2010-62424 A, however, firing is performed in a non-oxidizing atmosphere in vacuum, or without oxygen or at a low oxygen partial pressure, and therefore it is difficult to control the firing atmosphere and costs of equipment are increased, so that running costs may be raised.

That is, in JP 2010-62424 A, when the firing treatment is performed in an air atmosphere, the surfaces of particles are oxidized to form an oxide layer, and therefore the apparent relative permittivity may increase. As a result, the stray capacitance of the electronic component may increase, leading to deterioration of high-frequency characteristics.

Thus, in JP 2010-62424 A, firing must be performed in a non-oxidizing atmosphere as described above, and it is therefore difficult to control the firing atmosphere, so that costs may be increased.

The present disclosure has been devised in view of the situations described above, and an object of the present disclosure is to provide a laminated coil component having high reliability in which good high-frequency characteristics and magnetic characteristics can be obtained without impairing insulation quality, and occurrence of structural defects such as cracking and peeling can be suppressed, and a method for producing the laminated coil component.

Means for Solving the Problem

A metal magnetic material is known to have excellent direct-current superimposition characteristics because it has a higher saturation magnetic flux density and is harder to be magnetically saturated as compared to the ferrite-based magnetic material described above.

Thus, the present inventors formed a nonmagnetic material part using a ceramic material, formed a magnetic material part so as to cover the nonmagnetic material part using a metal magnetic material, and further formed a coil conductor so that the main surface of a coil pattern was in contact with the nonmagnetic material part. Then, the present inventors extensively conducted studies, and resultantly arrived at the following findings. When the magnetic material part contains a glass component in an amount of 46 to 60 vol % based on the total amount of the metal magnetic material and the glass component, and the nonmagnetic material part contains a glass component in an amount of 69 to 79 vol % based on the total amount of the ceramic material and the glass component, there can be obtained a laminated coil component having high reliability in which good high-frequency characteristics and magnetic characteristics can be obtained without impairing insulation quality, and occurrence of structural defects such as cracking and peeling can be suppressed.

The present disclosure has been devised based on the above-mentioned findings. The laminated coil component according to the present disclosure includes a magnetic material part containing a metal magnetic material and a first glass component, and a nonmagnetic material part containing a ceramic material and a second glass component. A coil conductor is formed so that at least the main surface of a coil pattern is in contact with the nonmagnetic material part. The magnetic material part is formed so that the content of the first glass component is 46 to 60 vol % in terms of a volume ratio based on the total amount of the metal magnetic material and the first glass component, and the nonmagnetic material part is formed so that the content of the second glass component is 69 to 79 vol % in terms of a volume ratio based on the total amount of the ceramic material and the second glass component.

The laminated coil component of the present disclosure is preferably one wherein the first glass component and the second glass component have the same main component.

Hereby, a difference in shrinkage behavior and thermal expansion coefficient between the magnetic material part and the nonmagnetic material part can be reduced during firing, and structural defects such as cracking and peeling can be effectively suppressed, so that reliability can be further improved.

The laminated coil component of the present disclosure is preferably one wherein the first and second glass components are each a borosilicate alkaline glass containing silicon, boron and an alkali metal element as main components.

Hereby, a dense glass phase excellent in plating liquid resistance can be formed.

Further, the laminated coil component of the present disclosure is preferably one wherein the first and second glass components have a softening point of 650 to 800° C.

Hereby, dense glass phases composed of the first and second glass components are formed between metal magnetic particles and between ceramic particles by a firing treatment, so that generation of gaps between the metal magnetic particles and between the ceramic particles can be suppressed. Therefore, humidity resistance and plating resistance can be further improved, so that ingress of moisture and a plating liquid can be maximally avoided, and elution of the glass component in the plating liquid can be effectively suppressed even when a plating treatment is performed in a post-process.

The laminated coil component of the present disclosure is preferably one wherein the metal magnetic material includes any one of a Fe—Si—Cr-based material containing at least Fe, Si and Cr, and a Fe—Si—Al-based material containing at least Fe, Si and Al.

Hereby, when firing is performed in an oxidizing atmosphere such as an air atmosphere, Cr and Al are oxidized to form passive films composed of $Cr_2O_3$ and $Al_2O_3$ on the surfaces of particles, resulting in improvement of rust prevention performance, so that higher reliability can be secured.

The laminated coil component of the present disclosure is preferably one wherein the ceramic material contains $Al_2O_3$ as a main component.

In this type of laminated coil component, when a firing treatment is performed in an air atmosphere, an oxide film may be formed on a surface of the metal magnetic material contained in the magnetic material part to thereby increase the apparent relative permittivity of the magnetic material part, leading to deterioration of high-frequency characteristics.

However, as a result of studies by the present inventors, it has become apparent that when a glass component is contained so that the content of the glass component after firing is 46 to 60 vol % based on the total amount of a metal magnetic material and the glass component, and a coil conductor is formed so that a nonmagnetic material layer composed of a glass ceramic containing a predetermined amount of a glass component and having a low dielectric constant is in contact with the main surface of a coil pattern, good insulation quality and high-frequency characteristics can be secured when firing is performed not only in a non-oxidizing atmosphere such as a nitrogen atmosphere but also in an oxidizing atmosphere such as an air atmosphere.

That is, a method for producing a laminated coil component according to the present disclosure includes: a magnetic material paste preparation step of preparing a magnetic material paste containing at least a metal magnetic material and a first glass component so that the content of the first glass component based on the total amount of the metal magnetic material and the first glass component is 46 to 60 vol % in terms of a volume ratio after firing; a nonmagnetic material paste preparation step of preparing a nonmagnetic material paste containing at least a ceramic material and a second glass component so that the content of the second glass component based on the total amount of the ceramic material and the second glass component is 69 to 79 vol % in terms of a volume ratio after firing; a conductive paste preparation step of preparing a conductive paste containing a conductive powder as a main component; a laminated molded article preparation step of preparing a laminated molded article by laminating a nonmagnetic material layer formed using the nonmagnetic material paste, a conductor part formed using the conductive paste and a magnetic material layer formed using the magnetic material paste, in a predetermined order so that the conductor part is in the form of a coil; and a firing step of firing the laminated molded article.

The method for producing a laminated coil component according to the present disclosure is preferably one wherein the firing step is carried out in an oxidizing atmosphere.

Hereby, good insulation quality and high-frequency characteristics can be secured when firing is performed not only in a nitrogen atmosphere but also in an oxidizing atmosphere, and therefore the firing atmosphere is easily controlled, so that a laminated coil component having good magnetic characteristics and humidity resistance/plating liquid resistance and having high reliability can be easily obtained at low costs.

Effects of the Disclosure

The laminated coil component according to the present disclosure includes a magnetic material part containing a metal magnetic material and a first glass component, and a nonmagnetic material part containing a ceramic material and a second glass component. A coil conductor is formed so that at least the main surface of a coil pattern is in contact with the nonmagnetic material part. The magnetic material part is formed so that the content of the first glass component is 46 to 60 vol % in terms of a volume ratio based on the total amount of the metal magnetic material and the first glass component, and the nonmagnetic material part is formed so that the content of the second glass component is 69 to 79 vol % in terms of a volume ratio based on the total amount of the ceramic material and the second glass component. Therefore, a glass phase can be formed between metal magnetic particles. Moreover, since at least the main surface of the coil pattern is in contact with the nonmagnetic material part composed of a glass ceramic having a low relative permittivity, an increase in stray capacitance can be suppressed. Hereby, there can be obtained a laminated coil component having high reliability in which good high-frequency characteristics and magnetic characteristics can be obtained without impairing insulation quality, and occurrence of structural defects such as cracking and peeling can be suppressed.

The method for producing a laminated coil component according to the present disclosure includes: a magnetic material paste preparation step of preparing a magnetic material paste containing at least a metal magnetic material and a first glass component so that the content of the first glass component based on the total amount of the metal magnetic material and the first glass component is 46 to 60 vol % in terms of a volume ratio after firing; a nonmagnetic material paste preparation step of preparing a nonmagnetic material paste containing at least a ceramic material and a second glass component so that the content of the second glass component based on the total amount of the ceramic material and the second glass component is 69 to 79 vol % in terms of a volume ratio after firing; a conductive paste preparation step of preparing a conductive paste containing a conductive powder as a main component; a laminated molded article preparation step of preparing a laminated molded article by laminating a nonmagnetic material layer formed using the nonmagnetic material paste, a coil pattern formed using the conductive paste and a magnetic material layer formed using the magnetic material paste, in a predetermined order so that the conductor part is in the form of a coil; and a firing step of firing the laminated molded article. Therefore, a laminated coil component being capable of securing good insulation quality and high-frequency characteristics, having good magnetic characteristics and humidity resistance/plating liquid resistance and having high reliability can be easily obtained.

DETAILED DESCRIPTION

Embodiments of the present disclosure will now be described in detail.

Figure 1:
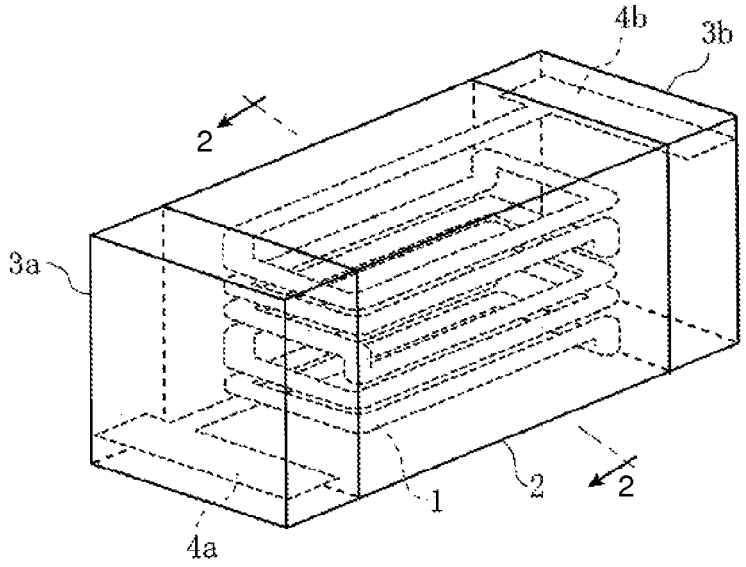
FIG. 1 is a perspective view showing one embodiment of a laminated coil component according to the present disclosure.
Figure 2:
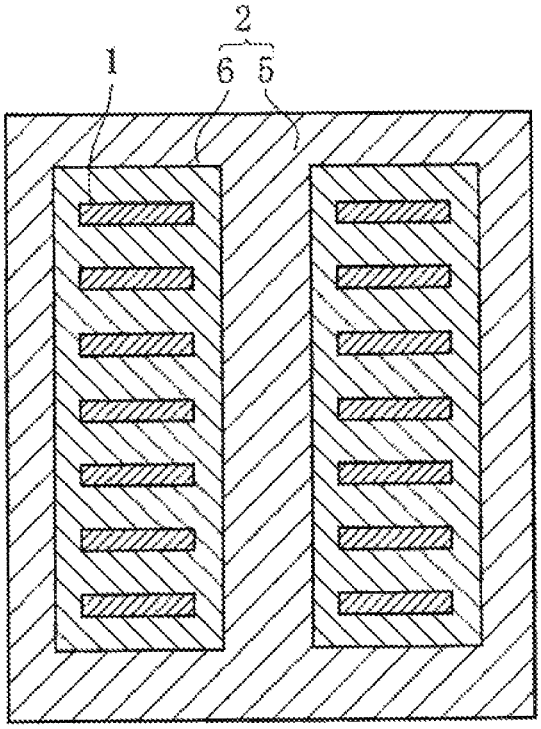
FIG. 2 is a 2-2 arrow sectional view of FIG. 1.

FIG. 1 is a perspective view showing one embodiment of a laminated coil component according to the present disclosure, and FIG. 2 is a sectional view of FIG. 1 taken along line 2-2.

In the present laminated coil component, a coil conductor 1 is embedded in a component element assembly 2, and external electrodes 3*a* and 3*b* composed of Ag etc. are formed at both ends of the component element assembly 2. Extraction electrodes 4*a* and 4*b* are formed at both ends of the coil conductor 1, and the extraction electrodes 4*a* and 4*b* are electrically connected to the external electrodes 3*a* and 3*b*.

Specifically as shown in FIG. 2, the component element assembly 2 has a magnetic material part 5 and a nonmagnetic material part 6, and the coil conductor 1 is formed so that at least the main surface of a coil pattern is in contact with the nonmagnetic material part 6. In the first embodiment, the nonmagnetic material part 6 is formed so as to cover the surface of the coil conductor 1. The magnetic material part 5 is formed in contact with the nonmagnetic material part 6 so as to cover the surface of the nonmagnetic material part 6.

The magnetic material part 5 contains a metal magnetic material and a first glass component, and the volume content of the first glass component based on the total amount of the metal magnetic material and the first glass component is 46 to 60 vol %. The nonmagnetic material part 6 contains a ceramic material and a second glass component, and the volume content of the second glass component based on the total amount of the ceramic material and the second glass component is 69 to 79 vol %.

Hereby, a glass phase can be formed between metal magnetic particles, and moreover an increase in stray capacitance can be suppressed because the periphery of the coil conductor 1 is formed of the nonmagnetic material part 6 composed of a glass ceramic having a low relative permittivity. In this manner, there can be obtained a laminated coil component having high reliability in which good high-frequency characteristics and magnetic characteristics can be obtained without impairing insulation quality, and occurrence of structural defects such as cracking and peeling can be suppressed.

The reason why the volume contents of the first glass component and the second glass component are made to fall within the above-mentioned range will now be described in detail.

(1) First Glass Component

When the magnetic material part 5 contains the first glass component in addition to the metal magnetic material, a dense glass phase can be formed between metal magnetic particles, and an increase in apparent relative permittivity can be avoided. Hereby, magnetic characteristics are not impaired, insulation quality can be improved to secure moisture-absorption resistance and plating liquid resistance, and good high-frequency characteristics are maintained.

However, when the volume content of the first glass component based on the total amount of the metal magnetic material and the first glass component in the magnetic material part 5 is less than 46 vol %, the volume content of the first glass component decreases, and therefore it is difficult to form a glass phase for sufficiently filling a gap between metal magnetic particles, so that insulation quality may be degraded, leading to deterioration of moisture-absorption resistance and plating resistance. Since the volume content of the first glass component is small, the apparent relative permittivity may increase to deteriorate high-frequency characteristics when firing is performed in an oxidizing atmosphere such as an air atmosphere.

On the other hand, when the volume content of the first glass component based on the total amount of the metal magnetic material and the first glass component in the magnetic material part 5 is more than 60 vol %, the volume content of the metal magnetic material may excessively decrease, resulting in deterioration of magnetic characteristics such as an initial magnetic permeability.

Thus, in this embodiment, the blending amounts of the metal magnetic material and the first glass component are adjusted so that the volume content of the first glass component based on the total amount of the metal magnetic material and the first glass component is 46 to 60 vol %.

(2) Second Glass Component

When the periphery of the coil conductor 1 is covered with the nonmagnetic material part 6 formed of a glass ceramic (ceramic material+glass component) having a low relative permittivity, a stray capacitance generated between coil conductors 1 can be reduced, so that high-frequency characteristics can be improved.

However, when the volume content of the second glass component based on the total amount of the ceramic material and the second glass component in the nonmagnetic material part 6 is less than 69 vol %, the amount of the second glass component is excessively small, and therefore the sinterability of the nonmagnetic material part 6 is deteriorated, so that a large difference in shrinkage behavior may be generated between the magnetic material part 5 and the nonmagnetic material part 6, leading to occurrence of structural defects such as cracking and peeling at an interface between the magnetic material part 5 and the nonmagnetic material part 6. Moreover, since the nonmagnetic material part 6 is poor in sinterability, a dense glass phase cannot be formed, and moisture-absorption resistance and plating liquid resistance may be deteriorated.

On the other hand, when the volume content of the second glass component based on the total amount of the ceramic material and the second glass component in the nonmagnetic material part 6 is more than 79 vol %, a difference in thermal expansion coefficient between the nonmagnetic material part 6 and the magnetic material part 5 may increase, leading to occurrence of structural defects such as cracking and peeling at an interface between the magnetic material part 5 and the nonmagnetic material part 6.

Thus, in this embodiment, the blending amounts of the ceramic material and the second glass component are adjusted so that the volume content of the second glass component based on the total amount of the ceramic material and the second glass component is 69 to 79 vol %.

Such glass components are not particularly limited as long as the first and second glass components satisfy the above-mentioned volume contents, but for more sufficiently securing an effect of suppressing structural defects, it is preferred that the first glass component and the second glass component have the same main component. That is, when the first glass component and the second glass component are formed of glass materials having the same main component, a difference in shrinkage behavior and thermal expansion coefficient can be reduced during firing, and structural defects such as cracking and peeling can be further effectively suppressed.

Further, as a specific type of material of the first and second glass components, a borosilicate alkaline glass containing Si, B and an alkali metal element is preferably used. An alkali metal oxide such as $Li_2O$, $K_2O$ or $Na_2O$ can form a dense glass phase excellent in plating liquid resistance, when the alkali metal oxide is contained together with $SiO_2$ and $B_2O_3$ which is hard to be eluted in a plating liquid and which each act as a net-like oxide.

The softening points of the first and second glass components are not particularly limited, but are preferably 650 to 800° C.

That is, by heat-treating a mixture of the metal magnetic material and the first glass and a mixture of the ceramic material and the second glass component, a dense glass phase can be formed.

However, it is not preferred that the softening point of the glass component is lower than 650° C. because the content of the Si component in the glass component excessively decreases, and resultantly the glass component is easily eluted in a plating liquid during a plating treatment.

On the other hand, when the softening point of the glass component is higher than 800° C., the content of the Si component in the glass component excessively increases to reduce the fluidity of the glass component, so that a desired dense glass phase may not be obtained.

The metal magnetic material contained in the magnetic material part 5 is not particularly limited, but it is preferred to use a Fe—Si—Cr-based material containing at least Fe, Si and Cr, or a Fe—Si—Al-based material containing at least Fe, Si and Al. That is, by using a Fe—Si—Cr-based or Fe—Si—Al-based metal magnetic material containing Cr or Al which is more easily oxidized than Fe, Cr or Al can be oxidized to form passive films of $Cr_2O_3$ or $Al_2O_3$ on the surfaces of metal magnetic particles when firing is performed in an oxidizing atmosphere such as an air atmosphere. Hereby, rust prevention performance is improved, so that reliability can be improved.

The ceramic material contained in the nonmagnetic material part 6 is not particularly limited, but usually $Al_2O_3$ is preferably used.

The material for a coil conductor is not particularly limited, but a metal material containing Ag, which has oxidation resistance to the extent that firing possible even in an oxidizing atmosphere such as an air atmosphere and which has low resistance and is relatively inexpensive, as a main component can be preferably used.

Thus, according to this embodiment, the laminated coil component includes the magnetic material part 5 containing a metal magnetic material and a first glass component, and the nonmagnetic material part 6 containing a ceramic material such as $Al_2O_3$ and a second glass component. The coil conductor 1 of Ag or the like is formed on the nonmagnetic material part. The magnetic material part 5 contains the first glass component in an amount of 46 to 60 vol % in terms of a volume content based on the total amount of the metal magnetic material and the first glass component, and the nonmagnetic material part contains the second glass component in an amount of 65 to 79 vol % in terms of a volume ratio based on the total amount of the ceramic material and the second glass component. Therefore, a glass phase can be formed between metal magnetic particles, and moreover the periphery of the coil conductor is formed of the nonmagnetic material part composed of a glass ceramic having a low relative permittivity, so that an increase in stray capacitance can be suppressed. Hereby, there can be obtained a laminated coil component having high reliability in which good high-frequency characteristics and magnetic characteristics can be obtained without impairing insulation quality, and occurrence of structural defects such as cracking and peeling can be suppressed.

Hereby, when the first glass component and the second glass component have the same main component, a difference in shrinkage behavior and thermal expansion coefficient between the magnetic material part 5 and the nonmagnetic material part 6 can be reduced during firing, and structural defects such as cracking and peeling can be further effectively suppressed, so that reliability can be improved.

When the first and second glass components are each a borosilicate alkaline glass containing silicon, boron and an alkali metal element as main components, a dense glass phase excellent in plating liquid resistance can be formed.

When the softening points of the first and second glass components are 650 to 800° C., dense glass phases composed of the first and second glass components are formed between metal magnetic particles and between ceramic particles by a firing treatment, so that generation of gaps between the metal magnetic particles and between the ceramic particles can be suppressed. That is, humidity resistance and plating resistance can be further improved, so that ingress of moisture and a plating liquid can be maximally avoided, and elution of the glass component in the plating liquid can be effectively suppressed even when a plating treatment is performed in a post-process.

Further, when a Fe—Si—Cr-based or Fe—Si—Al-based metal magnetic material containing Cr or Al which is more easily oxidized than Fe is used as a metal magnetic material, Cr or Al can be oxidized to form passive films composed of $Cr_2O_3$ or $Al_2O_3$ on the surfaces of particles, and rust prevention performance is improved, so that higher reliability can be secured when firing is performed in an oxidizing atmosphere.

Thus, according to the present laminated coil component, there can be obtained a laminated coil component in which occurrence of structural defects such as cracking and peeling can be suppressed and which has good various kinds of characteristics and insulation performance and is excellent in high-frequency characteristics and reliability.

A method for producing the laminated coil component will now be described in detail.

(1) Preparation of Magnetic Material Paste

A metal magnetic material such as a Fe—Si—Cr-based material or a Fe—Si—Al-based material, and a first glass component such as a borosilicate alkaline glass are provided.

The metal magnetic material and the first glass component are weighed so that the volume content of the first glass component based on the total amount of the metal magnetic material and the first glass component is 46 to 60 vol % after firing, and the metal magnetic material and the first glass component are mixed to prepare a magnetic material raw material.

Next, an organic solvent, an organic binder, and additives such as a dispersant and a plasticizer are weighed in an appropriate amount, and kneaded together with the magnetic material raw material, and the kneaded product is formed into a paste to prepare a magnetic material paste.

(2) Preparation of Nonmagnetic Material Paste

A ceramic material such as $Al_2O_3$ and second glass component such as a borosilicate alkaline glass are provided.

The ceramic material and the second glass component are weighed so that the volume content of the second glass component based on the total amount of the metal magnetic material and the second glass component is 69 to 79 vol % after firing, and the ceramic material and the second glass component are mixed to prepare a nonmagnetic material raw material.

Next, an organic solvent, an organic binder, and additives such as a dispersant and a plasticizer are weighed in an appropriate amount, and kneaded together with the nonmagnetic material raw material, and the kneaded product is formed into a paste to prepare a nonmagnetic material paste.

(3) Preparation of Conductive Paste for Coil Conductor (Hereinafter, Referred to "Coil Conductor Paste")

A varnish and an organic solvent are added to a conductive material such as an Ag powder, and the mixture is kneaded to thereby prepare a coil conductor paste containing a conductive material as a main component.

(4) Preparation of Laminated Molded Article

FIGS. 3 to 8 are plan views each showing a preparation process of a laminated molded article. Usually, a multiple-piece production system in which multiple laminated molded articles are simultaneously prepared on a large-sized base film is employed, but in this embodiment, a case is described where one laminated molded article is prepared for convenience of explanation.

Figure 3A:
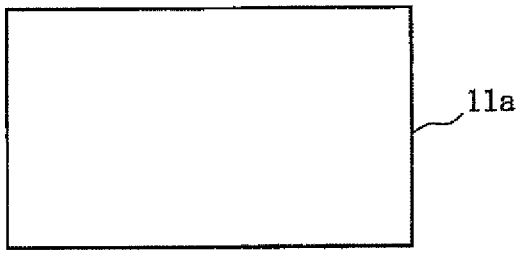
FIGS. 3(*a*), 3(*b*), and 3(*c*) depict a production flow chart (1/6) of a laminated molded article that is an intermediate product of the laminated coil component.
Figure 3B:
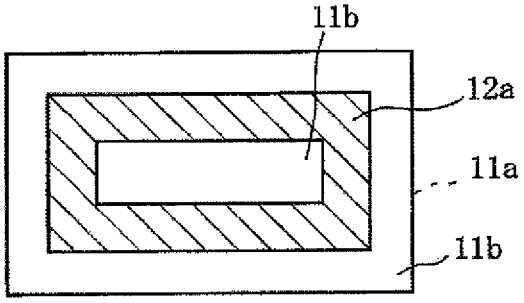
Figure 3C:
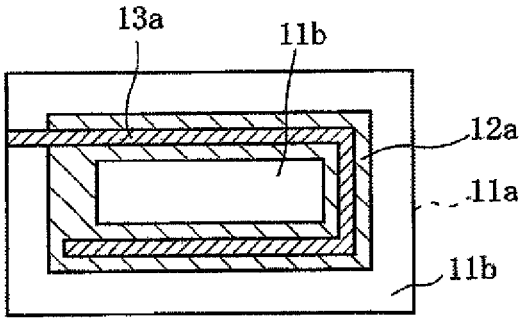

First, as shown in FIG. 3(*a*), a first magnetic material layer 11*a* having a predetermined thickness is prepared by repeating the following treatment: the magnetic material paste is applied onto a base film of PET (polyethylene terephthalate) etc. by a screen printing method or the like, and dried.

Next, as shown in FIG. 3(*b*), the nonmagnetic material paste is applied to a predetermined region of the surface of the first magnetic material layer 11*a*, and dried to form a hollow rectangle-shaped first nonmagnetic material layer 12*a* having a predetermined width. Then, the magnetic material paste is applied to an area where the first nonmagnetic material layer 12*a* is not formed, i.e. the hollow portion in the first nonmagnetic material layer 12*a* and the outside, and dried to thereby prepare a second magnetic material layer 11*b*.

Thereafter, as shown in FIG. 3(*c*), the coil conductor paste is applied to the surface of the first nonmagnetic material layer 12*a*, so that a first conductor part 13*a* having a width smaller than that of the first nonmagnetic material layer 12*a* is formed substantially in a U-shape. The first conductor part 13*a* is formed so that one end thereof is drawn to the end surface of the second magnetic material layer 11*b*.

Figure 4D:
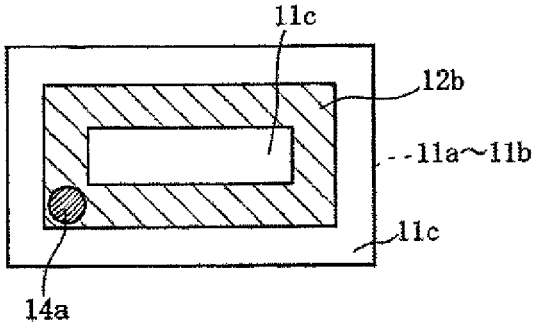
FIGS. 4(*d*), 4(*e*), and 4(*f*) depict a production flow chart (2/6) of the laminated molded article that is an intermediate product of the laminated coil component.
Figure 4E:
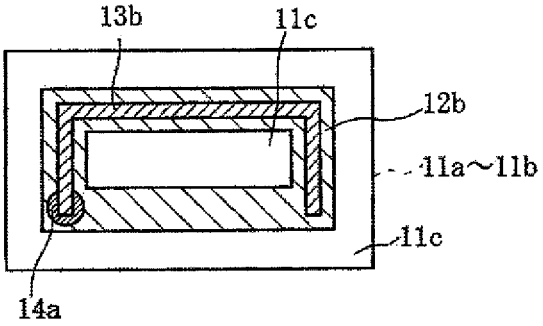
Figure 4F:
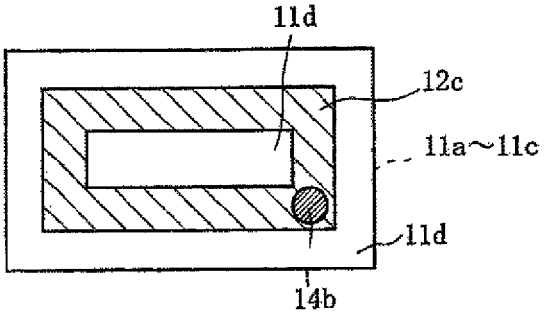

Next, as shown in FIG. 4(*d*), the nonmagnetic material paste is applied onto the first magnetic material layer 12*a*, and dried to form a second nonmagnetic material layer 12*b* identical in shape to the first nonmagnetic material layer 12*a*. Further, the magnetic material paste is applied to an area where the second nonmagnetic material layer 12*b* is not formed, and the paste is dried to form a third magnetic material layer 11*c*. A first conduction via 14*a* is formed at a predetermined location on the second nonmagnetic material layer 12*b* so that conduction between the second nonmagnetic material layer 12*b* and the first conductor part 13*a* is possible.

Then, as shown in FIG. 4(*e*), the coil conductor paste is applied to the surface of the second nonmagnetic material layer 12*b*, so that a second conductor part 13*b* having a width smaller than that of the second nonmagnetic material layer 12*b* is formed in a U-shape so as to be connected at one end to the first via conductor 14*a*.

Then, as shown in FIG. 4(*f*), the nonmagnetic material paste is applied onto the second nonmagnetic material layer 12*b*, and dried to form a third nonmagnetic material layer 12*c* identical in shape to the first and second nonmagnetic material layers 12*a* and 12*b*. Further, the magnetic material paste is applied to an area where the third nonmagnetic material layer 12*c* is not formed, and the paste is dried to form a fourth magnetic material layer 11*d*. A second conduction via 14*b* is formed at a predetermined location on the third nonmagnetic material layer 12*c* so that conduction between the third nonmagnetic material layer 12*c* and the second conductor part 13*b* is possible.

Figure 5G:
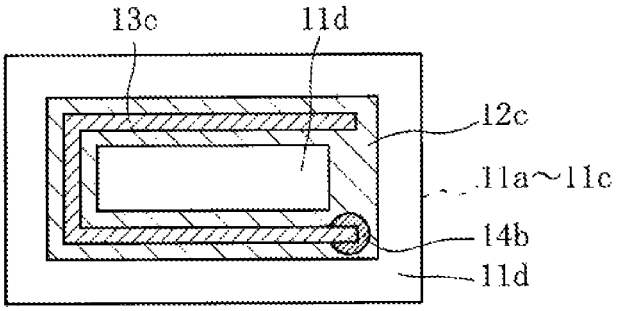
FIGS. 5(*g*) and 5(*h*) depict a production flow chart (3/6) of the laminated molded article that is an intermediate product of the laminated coil component.
Figure 5H:
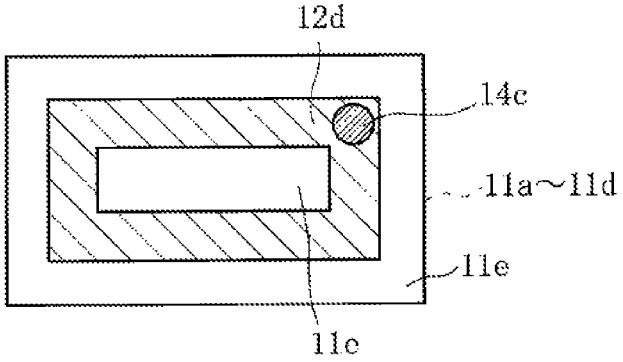

Next, as shown in FIG. 5(*g*), the coil conductor paste is applied to the surface of the third nonmagnetic material layer 12*c*, so that a third conductor part 13*c* having a width smaller than that of the third nonmagnetic material layer 12*c* is formed in a U-shape so as to be connected at one end to the second via conductor 14*b*.

Then, as shown in FIG. 5(*h*), the nonmagnetic material paste is applied onto the third nonmagnetic material layer 12*c*, and dried to form a fourth nonmagnetic material layer 12*d* identical in shape to the first to third nonmagnetic material layers 12*a* to 12*c*. Further, the magnetic material paste is applied to an area where the fourth nonmagnetic material layer 12*d* is not formed, and the paste is dried to form a fifth magnetic material layer 11*e*. A third conduction via 14*c* is formed at a predetermined location on the fourth nonmagnetic material layer 12*d* so that conduction between the fourth nonmagnetic material layer 12*d* and the third conductor part 13*c* is possible.

Figure 6I:
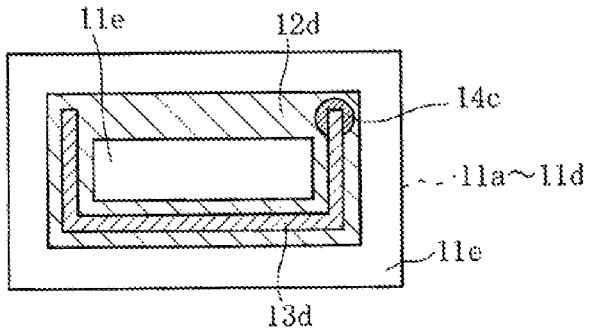
FIGS. 6(*i*), 6(*j*), and 6(*k*) depict a production flow chart (4/6) of the laminated molded article that is an intermediate product of the laminated coil component.
Figure 6J:
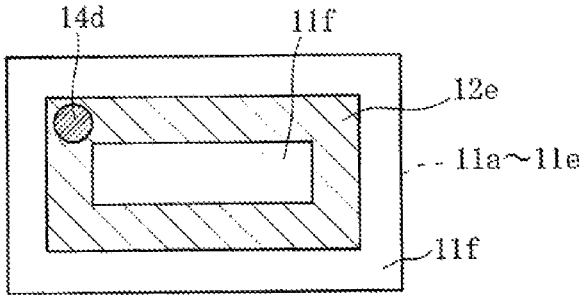
Figure 6K:
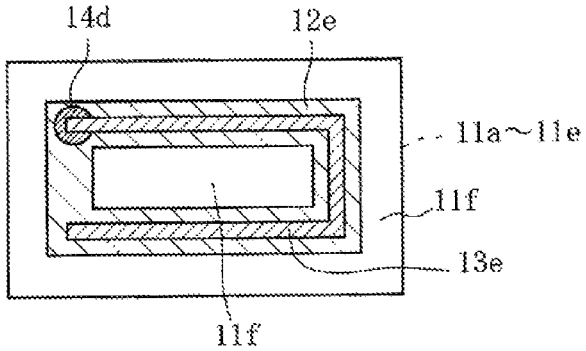
Figure 7L:
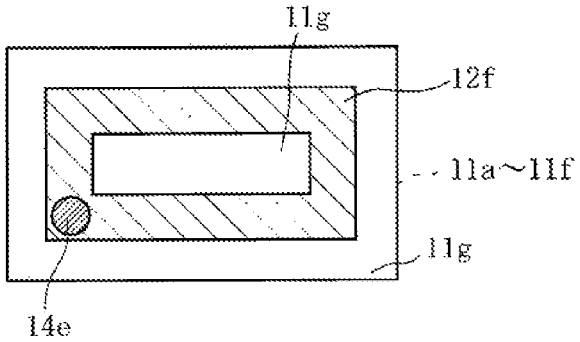
FIGS. 7(*l*), 7(*m*), and 7(*n*) depict a production flow chart (5/6) of the laminated molded article that is an intermediate product of the laminated coil component.
Figure 7M:
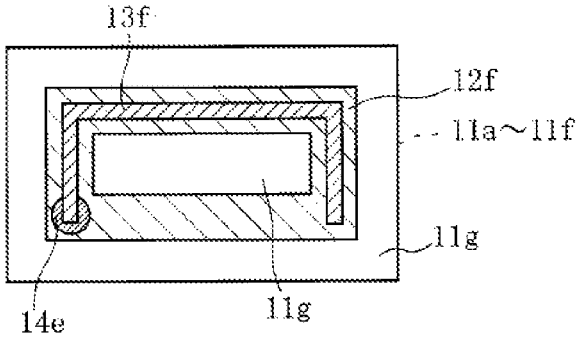
Figure 7N:
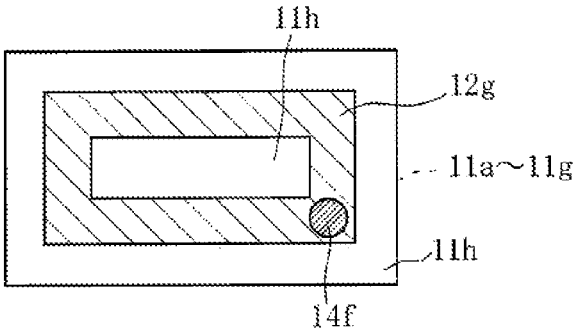

Subsequently, similar steps are repeated to sequentially prepare fifth to eighth magnetic material layers 11*e* to 11*h*, fourth to seventh nonmagnetic material layers 12*d* to 12*g*, fourth to sixth conductor parts 13*d* to 13*f* and third to sixth conduction vias 14*c* to 14*f* as shown in FIGS. 6(*i*) to 6(*k*) and FIGS. 7(*l*) to 7(*n*).

Figure 8O:
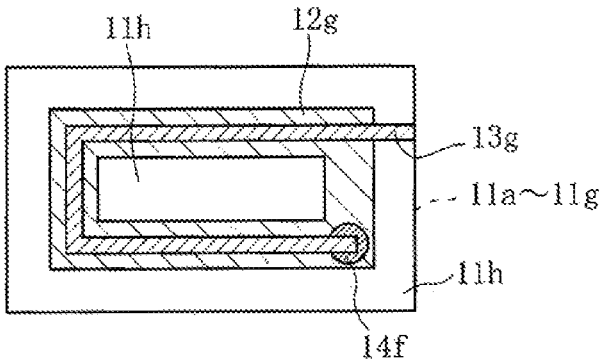
FIGS. 8(*o*), 8(*p*), and 8(*q*) depict a production flow chart (6/6) of the laminated molded article that is an intermediate product of the laminated coil component.
Figure 8P:
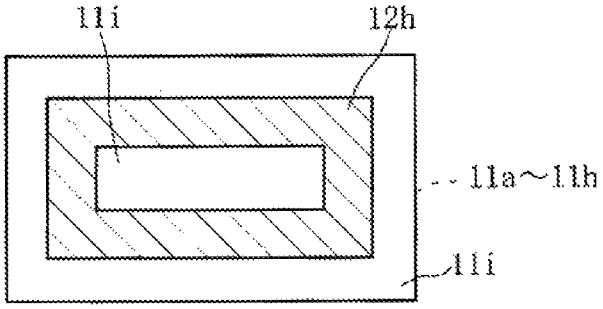
Figure 8Q:
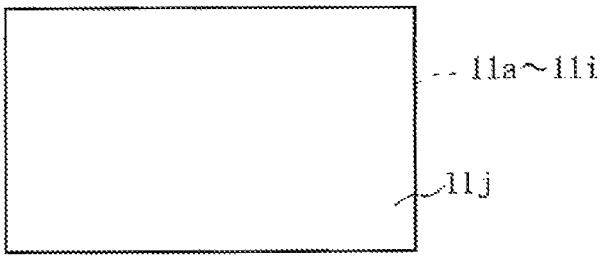

Thereafter, as shown in FIG. 8(*o*), the coil conductor paste is applied onto the seventh nonmagnetic material layer 12*g*, so that a seventh conductor part 13*g* having a width smaller than that of the seventh nonmagnetic material layer 12*g* is formed substantially in a U-shape so as to be connected at one end to the sixth conduction via 14*f*. The seventh conductor part 13*g* is formed so that the other end on a side opposite to the first conductor part 13*a* is drawn to the end surface of the eighth magnetic material layer 11*h*.

Then, as shown in FIG. 8(*p*), the nonmagnetic material paste is applied onto the seventh nonmagnetic material layer 12*g*, and dried to form an eighth nonmagnetic material layer 12*h* identical in shape to the first to seventh nonmagnetic material layers 12*a* to 12*g*. Further, the magnetic material paste is applied to an area where the eighth nonmagnetic material layer 12*h* is not formed, and the paste is dried to form a ninth magnetic material layer 11*i*.

Thereafter, as shown in FIG. 8(*q*), a tenth magnetic material layer 11*j* having a predetermined thickness is formed by repeating the following treatment: the magnetic material paste is applied onto the ninth magnetic material layer 11*i*, and dried. In this way, a laminated molded article is prepared.

(5) Firing Treatment

The laminated molded article thus prepared is introduced into a heat treatment furnace, heated at 300 to 500° C. for about 2 hours under an air atmosphere to perform a binder removing treatment, and thereafter fired at 850° C. for about 1 hour under an air atmosphere, whereby the first to tenth magnetic material layers 11*a* to 11*j*, the first to eighth nonmagnetic material layers 12*a* to 12*h*, the first to seventh conductor parts 13*a* to 13*g* and the first to sixth via conductors 14*a* to 14*f* are co-sintered to prepare a component element assembly 2 in which a coil conductor 1 having a predetermined coil pattern is formed in the nonmagnetic material part 6.

(6) Formation of External Electrode

A conductive paste for an external electrode, which contains as a main component a conductive material such as Ag, is provided. The conductive paste for an external electrode is applied to the end portion of the component element assembly 2, dried under an air atmosphere, and then fired at a temperature of 750 to 800° C. for a predetermined period of time to thereby prepare a laminated coil component.

Thus, the method for producing the present laminated coil component includes: a magnetic material paste preparation step of preparing a magnetic material paste containing at least a metal magnetic material and a first glass component so that the content of the first glass component based on the total amount of the metal magnetic material and the first glass component is 46 to 60 vol % in terms of a volume ratio after firing; a nonmagnetic material paste preparation step of preparing a nonmagnetic material paste containing at least a ceramic material and a second glass component so that the content of the second glass component based on the total amount of the ceramic material and the second glass component is 69 to 79 vol % in terms of a volume ratio after firing; a conductive paste preparation step of preparing a conductive paste containing a conductive powder as a main component; a laminated molded article preparation step of preparing a laminated molded article by laminating first to eighth nonmagnetic material layers 12*a* to 12*h* formed using the nonmagnetic material paste, first to seventh conductor parts 13*a* to 13*g* formed using the conductive paste and first to tenth magnetic material layers 11*a* to 11*j* formed using the magnetic material paste, in a predetermined order; and a firing step of firing the laminated molded article. Therefore, a laminated coil component being capable of securing good insulation quality and high-frequency characteristics, having good magnetic characteristics and humidity resistance/plating liquid resistance and having high reliability can be easily obtained.

Good insulation quality and high-frequency characteristics can be secured when the firing step is carried out not only in a non-oxidizing atmosphere such as a nitrogen atmosphere but also in an oxidizing atmosphere such as an air atmosphere, and therefore the firing atmosphere is easily controlled, so that a laminated coil component having good magnetic characteristics and humidity resistance/plating liquid resistance and having high reliability can be easily obtained at low costs.

That is, in the case of a conventional laminated coil component, firing must be performed in a non-oxidizing atmosphere because when the firing treatment is performed in an oxidizing atmosphere such as an air atmosphere, an oxide film may be formed on the surfaces of metal particles, which form the magnetic material part, to thereby increase the apparent relative permittivity of the magnetic material part, leading to deterioration of high-frequency characteristics.

On the other hand, in this embodiment, a glass component is contained in an amount of 46 to 60 vol % based on the total amount of a metal magnetic material and the glass component, and the periphery of the coil conductor 1 is covered with the nonmagnetic material layer 6 composed of a glass ceramic containing a predetermined amount of a glass component and having a low dielectric constant, so that good insulation quality and high-frequency characteristics can be obtained even when firing is performed in an oxidizing atmosphere such as an air atmosphere.

Figure 9:
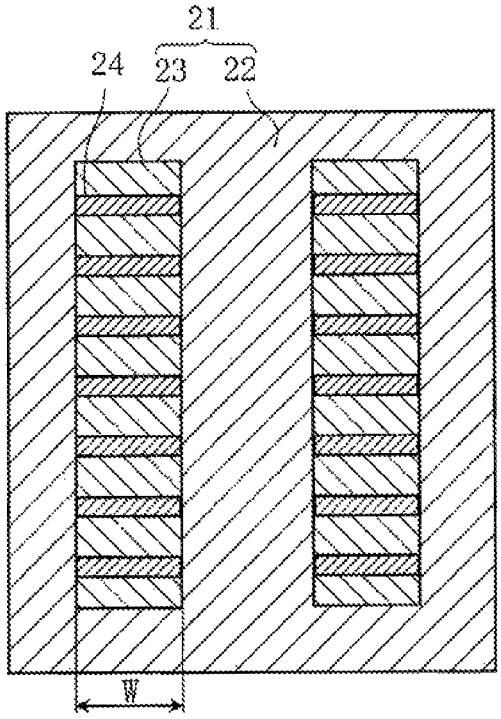
FIG. 9 is a sectional view showing a second embodiment of the laminated coil component.
Figure 10A:
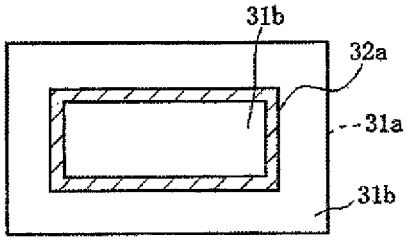
FIGS. 10(*a*), 10(*b*), 10(*c*), and 10(*d*) depict a production flow chart of a main part of a laminated molded article in the second embodiment.
Figure 10B:
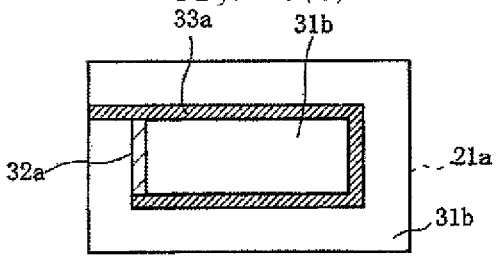
Figure 10C:
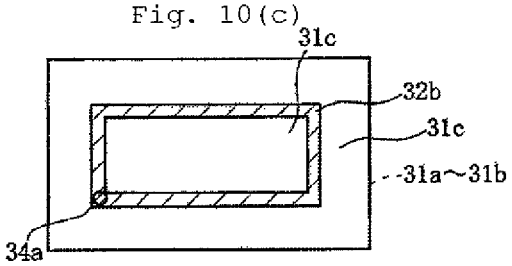
Figure 10D:
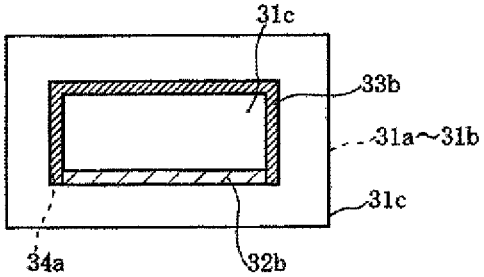

FIG. 9 is a sectional view showing a second embodiment of the laminated coil component.

A component element assembly 21 has a magnetic material part 22 and a nonmagnetic material part 23 similarly to the first embodiment. In the second embodiment, a coil conductor 24 is formed so that the main surface of a coil pattern is in contact with the nonmagnetic material part 23. That is, the nonmagnetic material part 23 and the coil conductor 24 are identical or substantially identical in width W, and the nonmagnetic material part 23 and the coil conductor 24 are in a laminated shape. The magnetic material part 22 is formed in contact with the nonmagnetic material part 23 (and the coil conductor 24) so as to cover the surface of the nonmagnetic material part 23 (and the coil conductor 24).

Thus, in the present disclosure, the coil conductor 24 should be formed so that at least the main surface of the coil pattern is in contact with the nonmagnetic material part 23, and even when as in the second embodiment, the coil conductor 24 is formed so that only the main surface of the coil pattern is in contact with the nonmagnetic material part 23 rather than covering the periphery of the coil conductor 1 with the nonmagnetic material part 6 as in the first embodiment, an increase in stray capacitance can be suppressed, and an effect similar to that of the first embodiment can be exhibited.

The laminated coil component of the second embodiment can be prepared by a method substantially similar to that in the first embodiment.

That is, first, by a method similar to that in the first embodiment, a magnetic material paste, a nonmagnetic material paste and a coil conductor paste are prepared, and a laminated molded article is then prepared.

FIG. 10 is a production flow chart of a main part of the laminated molded article in the second embodiment.

First, a first magnetic material layer having a predetermined thickness is prepared by repeating the following treatment: the magnetic material paste is applied onto a base film by a screen printing method or the like, and dried.

As shown in FIG. 10(*a*), the nonmagnetic material paste is applied to a predetermined region of the surface of the first magnetic material layer 31*a*, and dried to form a hollow rectangle-shaped first nonmagnetic material layer 32*a* identical or substantially identical in width to the conductor part. Then, the magnetic material paste is applied to an area where the first nonmagnetic material layer 32*a* is not formed, and the paste is dried to thereby prepare a second magnetic material layer 31*b*.

Then, as shown in FIG. 10(*b*), the coil conductor paste is applied to the surface of the first nonmagnetic material layer 32*a*, so that a first conductor part 33*a* identical or substantially identical in width to the first nonmagnetic material layer 32*a* is formed substantially in a U-shape.

Next, as shown in FIG. 10(*c*), the nonmagnetic material paste is applied onto the first nonmagnetic material layer 32*a*, and dried to form a second nonmagnetic material layer 32*b* identical in shape to the first nonmagnetic material layer 32*a*. Further, the magnetic material paste is applied to an area where the second nonmagnetic material layer 32*b* is not formed, and the paste is dried to form a third magnetic material layer 31*c*. A first conduction via 34*a* is formed at a predetermined location on the second nonmagnetic material layer 32*b* so that conduction between the second nonmagnetic material layer 32*b* and the first conductor part 33*a* is possible.

Next, as shown in FIG. 10(*d*), the coil conductor paste is applied to the surface of the second nonmagnetic material layer 32*b*, so that a second conductor part 33*b* having a width identical or substantially identical to that of the second nonmagnetic material layer 32*b* is formed in a U-shape so as to be connected at one end to the first via conductor 34*a*.

Subsequently, a laminated molded article is formed in accordance with a method/procedure similar to that in the first embodiment, and a firing treatment is then performed to form the component element assembly 21, followed by adding an external electrode, whereby the laminated coil component can be prepared.

The present disclosure is not limited to the embodiments described above, and various additional changes can be made without departing the spirit of the present disclosure.

Examples of the present disclosure will now be described in detail.

Example 1

A first glass component was included in a metal magnetic material to prepare magnetic material samples A to G different in volume content of a first glass component, and various kinds of characteristics of these magnetic material samples A to G were evaluated.

Preparation of Magnetic Material Paste

A Fe—Si—Cr-based magnetic alloy powder containing 92.0 wt % of Fe, 3.5 wt % of Si and 4.5 wt % of Cr and having an average particle size of 6 μm was provided as the metal magnetic material.

A glass powder containing 79 wt % of $SiO_2$, 19 wt % of $B_2O_3$ and 2 wt % of $K_2O$ and having an average particle size of 1 μμm and a softening point of 760° C. was provided as the first glass component.

Next, the magnetic alloy powder and the glass powder were weighed so as to have the blending ratio in Table 1, and mixed to obtain a magnetic material raw material.

To 100 parts by weight of the magnetic material raw material were added 26 parts by weight of dihydroterpinyl acetate as an organic solvent, 3 parts by weight of an ethyl cellulose resin as a binder resin and 1 part of a plasticizer, and the resulting mixture was kneaded to be formed into a paste, thereby preparing a magnetic material paste of each of sample Nos. A to G.

Preparation of Magnetic Material Sample

A magnetic material sheet having a thickness of 0.5 mm was prepared by repeating the following treatment: the magnetic material paste of each of sample Nos. A to G was applied onto a PET film, and dried.

Then, the magnetic material sheet was peeled off from the PET film, subjected to press processing, and punched to a disc shape having a diameter of 10 mm to prepare a disc-shaped molded article.

Similarly, the magnetic material sheet was peeled off from the PET film, subjected to press processing, and punched to a ring shape having an outer diameter of 20 mm and an inner diameter of 12 mm to prepare a ring-shaped molded article.

Then, these molded articles were subjected to a binder removing treatment at 350° C. under an air atmosphere, and then fired by performing a heat treatment at a temperature of 850° C. for 60 minutes under an air atmosphere, thereby preparing the disc-shaped sample and the ring-shaped sample of each of sample Nos. A to G.

Evaluation of Characteristics of Magnetic Material Sample

Next, for the disc-shaped sample of each of sample Nos. A to G, a weight was measured, the sample was then immersed in water for 60 minutes, and thereafter was drawn up, water on the surface was sucked and removed by a sponge, a weight after removal of water was then measured, and a water absorption ratio was calculated based on an increase in weight before and after immersion.

A conductive paste containing Ag as a main component was applied to both main surfaces of the disc-shaped sample of each of sample Nos. A to G, and baked at a temperature of 700° C. for 5 minutes to form an electrode.

A direct-current voltage of 50 V was applied to each of these samples, a resistance value after 1 minute was measured, and a specific resistance log ρ (ρ: Ω·cm) was determined from the measured resistance value and the sample dimension.

Further, the ring-shaped sample of each of sample Nos. A to G was held in a magnetic permeability measurement tool (16454A-s manufactured by Agilent Technologies, Inc.), and an initial magnetic permeability μi was measured at a measurement frequency of 1 MHz using an impedance analyzer (E4991A manufactured by Agilent Technologies, Inc.).

Table 1 shows the contents of the magnetic alloy powder (metal magnetic material) and the glass powder (first glass component) (before firing), the volume content of the glass powder (after firing) and measurement results.

Sample Nos. A and B had a high initial magnetic permeability μi of 8.6 and 7.2, but had a high water absorption ratio of 3.2% and 2.5% and a high relative permittivity ∈r of 99 and 85, respectively. Further, sample Nos. A and B had a low log p of 7.2 and 7.8, respectively. This is considered to be because the volume content of the glass powder in each of sample Nos. A and B was as low as less than 40 vol % with the former being 28 vol % and the latter being 38 vol %, thus making it unable to form a glass phase for sufficiently filling a gap between magnetic alloy powders, moisture-absorption resistance was resultantly reduced, so that a sufficiently specific resistance log p could not be obtained, insulation quality was thus deteriorated, and further, an oxide layer was formed on the surface of the magnetic alloy powder, resulting in an increase in relative permittivity.

On the other hand, Sample Nos. F and G had a low water absorption ratio of 0.01 and a low relative permittivity Er of 15 and 13, respectively, but since the volume content of the glass powder was as high as 65 to 70 vol %, and the volume content of the magnetic alloy powder was low, the initial magnetic permeability μi of each of sample Nos. F and G decreased to less than 5 with the former being 3.1 and the latter being 2.5.

On the other hand, in sample Nos. C to E, the volume content of the glass powder fell within the range specified in the present disclosure as it was 46 to 60 vol %, so that the water absorption ratio could be reduced to 0.1 to 0.01%, the specific resistance log ρ was not less than 8 as it was 8.1 to 8.8, an initial magnetic permeability μi of 5.4 to 6.7 could be secured, and the relative permittivity ∈r could be reduced to 17 to 20.

Therefore, it has become apparent that the volume content of the glass powder in the magnetic material part is required to be 46 to 60 vol % for satisfying all of moisture-absorption resistance, plating liquid resistance, insulation quality, magnetic characteristics and high-frequency characteristics.

Example 2

A second glass component was included in a ceramic material, various nonmagnetic material samples a to g different in volume content of the second glass component were prepared, and various kinds of characteristics of these nonmagnetic material samples a to g were evaluated.

TABLE 1

| | | | | Measurement results | | | |
|---|---|---|---|---|---|---|---|
| Sample No. | Magnetic alloy powder (wt %) | Glass powder (wt %) | Volume content of glass powder (vol %) | Water absorption ratio (%) | Specific resistance log ρ (ρ: Ω · cm) | Initial magnetic permeability μi (—) | Relative permittivity ∈r (—) |
| A* | 90 | 10 | 28 | 3.2 | 7.2 | 8.6 | 99 |
| B* | 85 | 15 | 38 | 2.5 | 7.8 | 7.2 | 85 |
| C | 80 | 20 | 46 | 0.1 | 8.1 | 6.7 | 20 |
| D | 75 | 25 | 54 | 0.01 | 8.2 | 6.2 | 18 |
| E | 70 | 30 | 60 | 0.01 | 8.8 | 5.4 | 17 |
| F* | 65 | 35 | 65 | 0.01 | 9.6 | 3.1 | 15 |
| G* | 60 | 40 | 70 | 0.01 | 9.4 | 2.5 | 13 |

*indicates that the result is out of the range specified in the present disclosure.

Preparation of Nonmagnetic Material Paste

A ceramic powder having an average particle size of 1 μm and composed of $Al_2O_3$ was provided as the ceramic material.

Similarly to the first glass component, a glass powder containing 79 wt % of $SiO_2$, 19 wt % of $B_2O_3$ and 2 wt % of $K_2O$ and having an average particle size of 1 μm and a softening point of 760° C. was provided as the second glass component.

Next, the ceramic powder and the glass powder were weighed so as to have the blending ratio in Table 2, and mixed to obtain a nonmagnetic material raw material.

To 100 parts by weight of the nonmagnetic material raw material were added 26 parts by weight of dihydroterpinyl acetate as an organic solvent, 3 parts by weight of an ethyl cellulose resin as a binder resin and 1 part of a plasticizer, and the resulting mixture was kneaded to be formed into a paste, thereby preparing a nonmagnetic material paste of each of sample Nos. a to g.

Preparation of Nonmagnetic Material Sample

A disc-shaped sample and a ring-shaped sample of each of sample Nos. a to g were prepared in accordance with a method/procedure similar to that in Example 1 using the nonmagnetic material paste of each of Sample Nos. a to g.

Evaluation of Characteristics of Nonmagnetic Material Sample

For the disc-shaped sample of each of sample Nos. a to g, a water absorption ratio, a specific resistance log p and a relative permittivity Er were determined in accordance with a method/procedure similar to that in Example 1.

For the ring-shaped sample of each of sample Nos. a to g, an initial magnetic permeability μi was measured in accordance with a method/procedure similar to that in Example 1.

Table 2 shows the contents of the ceramic powder (ceramic material) and the glass powder (second glass component) (before firing), the volume content of the glass powder (after firing) and measurement results.

TABLE 2

| | | | | Measurement results | | | |
|---|---|---|---|---|---|---|---|
| Sample No. | Ceramic powder (wt %) | Glass powder (wt %) | Volume content of glass powder (vol %) | Water absorption ratio (%) | Specific resistance log ρ (ρ: Ω · cm) | Initial magnetic permeability μi (—) | Relative permittivity εr (—) |
| a* | 45 | 55 | 60 | 1.2 | 14.6 | 1 | 7.1 |
| b* | 40 | 60 | 65 | 0.24 | 14.5 | 1 | 6.8 |
| c | 35 | 65 | 69 | 0.01 | 14.3 | 1 | 5.4 |
| d | 30 | 70 | 74 | 0.01 | 13.6 | 1 | 5.2 |
| e | 25 | 75 | 79 | 0.02 | 13.2 | 1 | 4.7 |
| f* | 20 | 80 | 83 | 0.04 | 12.4 | 1 | 4.6 |
| g* | 15 | 85 | 87 | 0.05 | 12.2 | 1 | 4.4 |

*indicates that the result is out of the range specified in the present disclosure.

Sample Nos. a and b had a relatively high water absorption ratio of 1.2% and 0.24%. This is considered to be because the volume content of the glass powder was as low as 60 vol % and 65 vol %, and therefore at a temperature of 850° C., a sufficiently dense glass phase could not be obtained even by performing a heat treatment.

On the other hand, in sample Nos. c to g, the volume content of the glass powder was not less than 69 vol %, and therefore the water absorption ratio was 0.01 to 0.05%, so that a dense glass phase could be obtained, and a sufficiently large value of 12.2 to 14.3 could be obtained as a specific resistance log ρ.

However, in sample Nos. f and g, the volume content of the glass powder is more than 79% as it is 83 to 87 vol %, and therefore it is improper to form a nonmagnetic material part using these sample Nos. f and g because structural defects such as cracking and peeling may occur at an interface between the magnetic material part and the nonmagnetic material part as described later.

Example 3

Magnetic material pastes C to E having a low water absorption ratio and relative permittivity Er and a good initial magnetic permeability μi in the magnetic material pastes prepared in Example 1 were used in combination of the nonmagnetic material pastes prepared in Example 2, so that various kinds of laminated coil components were prepared, and characteristics were evaluated.

Preparation of Laminated Coil Component

A laminated molded article was prepared in accordance with the method/procedure described in "MODE FOR CARRYING OUT THE DISCLOSURE" (see FIGS. 3 to 8).

That is, first, a first magnetic material layer having a predetermined thickness was prepared by repeating the following treatment: the magnetic material paste was applied onto a PET film by screen printing method, and dried.

Next, the nonmagnetic material paste was applied to a predetermined region on the surface of the first magnetic material layer by screen printing, and dried to form a hollow rectangle-shaped first nonmagnetic material layer having a predetermined width. Then, the magnetic material paste was applied to an area where the first nonmagnetic material layer was not formed (the hollow portion in the nonmagnetic material layer and the outside), and dried to thereby prepare a second magnetic material layer.

Then, a coil conductor paste containing Ag as a main component was provided. The coil conductor paste was applied onto the first nonmagnetic material layer by screen printing, so that a first conductor part having a width smaller than that of the first nonmagnetic material layer was formed substantially in a U-shape. The first conductor part was formed so that one end thereof was drawn to the end surface of the first magnetic material layer.

Next, the nonmagnetic material paste was applied onto the first nonmagnetic material layer by screen printing, and dried to form a second nonmagnetic material layer on the first nonmagnetic material layer. Thereafter, the magnetic material paste was applied to an area where the second nonmagnetic material layer was not formed, and the paste was dried to form a third magnetic material layer. A first conduction via was formed at a predetermined location on the second nonmagnetic material layer so that conduction between the second nonmagnetic material layer and the first conductor part was possible.

Then, the coil conductor paste was applied to the surface of the second nonmagnetic material layer by screen printing, and dried, so that a second conductor part having a width smaller than that of the second nonmagnetic material layer was formed in a U-shape so as to be connected at one end to the first via conductor.

Then, the nonmagnetic material paste was screen-printed onto the second nonmagnetic material layer, and dried to form a third nonmagnetic material layer. Further, the magnetic material paste was applied to an area where the third nonmagnetic material layer was not formed, and the paste was dried to form a fourth magnetic material layer. A second conduction via was formed at a predetermined location on the third nonmagnetic material layer so that conduction between the third nonmagnetic material layer and the second conductor part was possible.

Next, the coil conductor paste was applied to the surface of the third nonmagnetic material layer, so that a third conductor part having a width smaller than that of the third nonmagnetic material layer was formed in a U-shape so as to be connected at one end to the second via conductor.

Subsequently, a similar step was repeated, so that the magnetic paste was applied onto the nonmagnetic material layer at the uppermost layer, and repeatedly dried to form a magnetic material layer having a predetermined thickness, thereby preparing a laminated molded article. The conductor part at the uppermost layer was formed so that the other end on a side opposite to the first conductor part was drawn to the end surface of the magnetic material layer.

The laminated molded article thus prepared was introduced into a heat treatment furnace, heated at 400° C. for about 2 hours under an air atmosphere to perform a binder removing treatment, and then fired at 850° C. for about 1 hour under an air atmosphere to thereby prepare a sintered body (component element assembly) of each of sample Nos. 1 to 9.

Next, a conductive paste for an external electrode, which contained Ag as a main component and contained a glass powder and varnish, was provided. The conductive paste for an external electrode was applied to the end portion of the sintered body using an immersion method, and dried at 100° C. for 10 minutes under an air atmosphere, and a firing treatment was then performed at a temperature of 780° C. for 15 minutes under an air atmosphere to thereby prepare a sample of each of sample Nos. 1 to 9.

The outer dimension of the sample of each of sample Nos. 1 to 9 included a length of 2.5 mm, a width of 2.0 mm and a height of 1.5 mm, and the number of turns of the coil was adjusted so that the inductance L at 1 MHz (1 V) was about 1 μH.

Evaluation of Characteristics of Laminated Coil Component

For 50 samples for each of sample Nos. 1 to 9, the external appearance was observed with an optical microscope.

Each of these 50 samples was fixed with a resin so as to erect the side surface, the side surface was polished along the width direction of the sample over an area constituting about ½ of the side surface in the width direction, and the polished surface was observed with an optical microscope.

The samples were evaluated for structural defects based on the following criteria: a sample in which cracking and peeling did not occur at a joint between the magnetic material layer and the nonmagnetic material layer for both the external appearance and polished surface was rated as a non-defective product (○), and a sample in which such cracking and peeling occurred at one or more spots was rated as a defective product (x).

Table 3 shows the types of the magnetic material paste and the nonmagnetic material paste, and results of evaluation on structural defects.

TABLE 3

| Sample No. | Magnetic material paste | Nonmagnetic material paste | Evaluation on structural defects |
|---|---|---|---|
| 1* | D | a | x |
| 2* | D | b | x |
| 3 | D | c | ○ |
| 4 | D | d | ○ |
| 5 | D | e | ○ |
| 6* | D | f | x |
| 7* | D | g | x |
| 8 | C | d | ○ |
| 9 | E | d | ○ |
| 10* | C | a | x |
| 11* | C | b | x |
| 12 | C | c | ○ |
| 13 | C | e | ○ |
| 14* | C | f | x |
| 15* | C | g | x |
| 16* | E | a | x |
| 17* | E | b | x |
| 18 | E | c | ○ |
| 19 | E | e | ○s |
| 20* | E | f | x |
| 21* | E | g | x |

*indicates that the result is out of the range specified in the present disclosure.

Sample Nos. 1, 2, 10, 11, 16 and 17 had structural defects as cracking and peeling occurred at a joint between the magnetic material part and the nonmagnetic material part. This is considered to be because in sample Nos. 1, 2, 10, 11, 16 and 17, the nonmagnetic material part was formed using one of nonmagnetic material pastes a and b in which the volume contents of the glass powder in the nonmagnetic material part were 60 vol % and 65 vol %, respectively, and therefore the volume content of the glass component (second glass powder) in the nonmagnetic material layer was low, so that sinterability of the nonmagnetic material layer was deteriorated, and as a result, a difference in shrinkage behavior between the magnetic material layer and the nonmagnetic material layer increased, leading to occurrence of structural defects such as cracking and peeling.

Sample Nos. 6, 7, 14, 15, 20 and 21 also had structural defects as cracking and peeling occurred at a joint between the magnetic material part and the nonmagnetic material part. This is considered to be because in sample Nos. 6, 7, 14, 15, 20 and 21, the nonmagnetic material part was formed using one of nonmagnetic material pastes f and g in which the volume contents of the glass powder were 83 vol % and 87 vol %, respectively, and therefore the volume content of the glass component (second glass powder) in the nonmagnetic material layer was excessive, a difference in thermal expansion coefficient between the magnetic material layer and the nonmagnetic material layer increased, resulting in occurrence of structural defects such as cracking and peeling.

On the other hand, it has been confirmed that in sample Nos. 3 to 5, 8, 9, 12, 13, 18 and 19, the volume content of the glass powder in the nonmagnetic material part is 69 to 79 vol %, and the volume content of the glass powder in the magnetic material part is 46 to 60 vol %, each of which falls within the range specified in the present disclosure, so that structural defects such as cracking and peeling do not occur.

Example 4

A comparative example sample having no nonmagnetic material part was prepared, frequency characteristics of inductances of the present disclosure sample and the comparative example sample were measured, and the high-frequency characteristics of both the samples were compared.

Preparation of Comparative Example Sample

Figure 11:
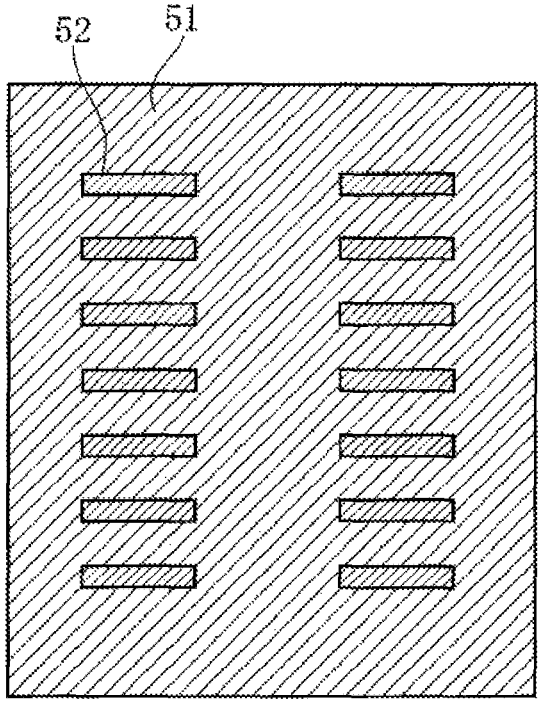
FIG. 11 is a sectional view of a comparative example sample prepared in an example.

As the comparative example sample, a laminated coil component with a coil conductor 52 embedded in a component element assembly 51 formed of a magnetic material raw material as shown in FIG. 11 was prepared using the magnetic material paste D prepared in Example 1.

Specifically, the comparative example sample was prepared in the following manner.

First, a first magnetic material layer having a predetermined thickness was prepared by repeating the following treatment: the magnetic material paste was applied onto a PET film by screen printing method, and dried.

Then, a coil conductor paste containing Ag as a main component was applied onto a first nonmagnetic material layer by screen printing, and dried to form a substantially U-shaped first conductor part. The first conductor part was formed so that one end thereof was drawn to the end surface of the first magnetic material layer.

Next, the magnetic material paste was applied onto the first magnetic material layer by screen printing, and dried to form a second magnetic material layer. A first conduction via was formed at a predetermined location on the first nonmagnetic material layer so that conduction between the first nonmagnetic material layer and the first conductor part was possible.

Subsequently, a similar step was repeated, so that a treatment of repeatedly applying the magnetic material paste onto the magnetic material layer at the uppermost layer and drying the paste was performed to form a magnetic material layer having a predetermined thickness, thereby preparing a laminated molded article. The conductor part at the uppermost layer was formed so that the other end on a side opposite to the first conductor part was drawn to the end surface of the magnetic material layer.

Thereafter, similarly to sample Nos. 1 to 9, the laminated molded article was subjected to a binder removing treatment, and fired, and an external electrode was then added to prepare a comparative example sample.

The outer dimension of the comparative example sample included a length of 2.5 mm, a width of 2.0 mm and a height of 1.5 mm similarly to sample Nos. 1 to 9, and the number of turns of the coil was adjusted so that the inductance L at 1 MHz (1 V) was about 1 μH.

Frequency Characteristics of Inductance

As the present disclosure sample, sample No. 4 was used. For the present disclosure sample and the comparative example sample, frequency characteristics of the inductance were measured in a range of 0.1 MHz to 100 MHz using an impedance analyzer (E4991A manufactured by Agilent Technologies, Inc.), and a resonance frequency was determined.

Figure 12:
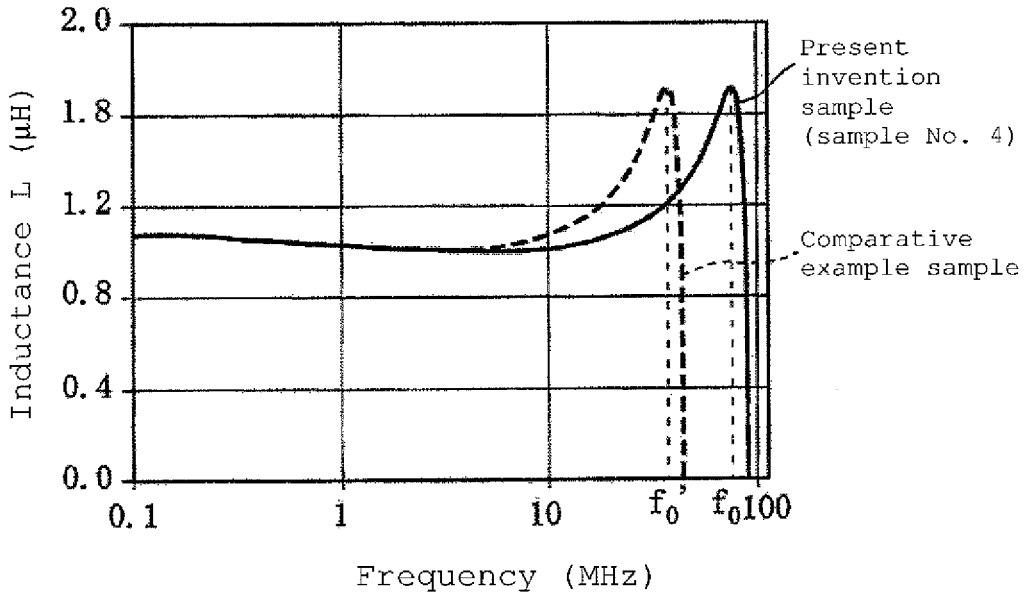
FIG. 12 is a view showing one example of frequency characteristics of an inductance of the present disclosure sample together with a comparative example sample.

FIG. 12 shows the results of the measurement. In FIG. 12, the abscissa represents a frequency (MHz), and the ordinate represents an inductance L (μH). In the abscissa, $f_0$ denotes a resonance frequency of the present disclosure sample, and $f_0'$ denotes a resonance frequency of the comparative example frequency.

As is evident from FIG. 12, the resonance frequency $f_0'$ of the comparative example sample was about 36 MHz, whereas the resonance frequency $f_0$ of the present disclosure sample was about 72 MHz. That is, it has become apparent that the present disclosure sample is superior in high-frequency characteristics to the comparative example sample, and can be used in a higher frequency band.

INDUSTRIAL APPLICABILITY

There can be provided a coil component of a choke coil, a laminated inductor coil component or the like having high reliability in which good high-frequency characteristics and magnetic characteristics can be obtained without impairing insulation quality, and occurrence of structural defects such as cracking and peeling can be suppressed.

The invention claimed is:

1. A laminated coil component comprising a magnetic material part containing a metal magnetic material and a first glass component, and a nonmagnetic material part containing a ceramic material and a second glass component, a coil conductor having at least a main surface of a coil pattern in contact with the nonmagnetic material part, the magnetic material part having a content of the first glass component being 46 to 60 vol % in terms of a volume ratio based on a total amount of the metal magnetic material and the first glass component, and the nonmagnetic material part having a content of the second glass component being 69 to 79 vol % in terms of a volume ratio based on a total amount of the ceramic material and the second glass component.

2. The laminated coil component according to claim 1, wherein the first glass component and the second glass component have a same main component.

3. The laminated coil component according to claim 1, wherein the first and second glass components are each a borosilicate alkaline glass containing silicon, boron and an alkali metal element as main components.

4. The laminated coil component according to claim 1, wherein the first and second glass components have a softening point of 650 to 800° C.

5. The laminated coil component according to claim 1, wherein the metal magnetic material includes one of a Fe—Si—Cr-based material containing at least Fe, Si and Cr, and a Fe—Si—Al-based material containing at least Fe, Si and Al.

6. The laminated coil component according to claim 1, wherein the ceramic material contains $Al_2O_3$ as a main component.

7. A method for producing a laminated coil component, the method comprising:

preparing a magnetic material paste containing at least a metal magnetic material and a first glass component so that a content of the first glass component based on a total amount of the metal magnetic material and the first glass component is 46 to 60 vol % in terms of a volume ratio after firing;

preparing a nonmagnetic material paste containing at least a ceramic material and a second glass component so that a content of the second glass component based on a total amount of the ceramic material and the second glass component is 69 to 79 vol % in terms of a volume ratio after firing;

preparing a conductive paste containing a conductive powder as a main component;

preparing a laminated molded article by laminating a nonmagnetic material layer formed using the nonmagnetic material paste, a conductor part formed using the conductive paste and a magnetic material layer formed using the magnetic material paste, in a predetermined order so that a conductor part is in a form of a coil; and firing the laminated molded article.

8. The method for producing a laminated coil component according to claim 7, wherein the firing is carried out under an oxidizing atmosphere.

* * * * *